United States Patent [19]

Biot et al.

[11] 4,356,603

[45] Nov. 2, 1982

[54] METHOD FOR INTRODUCING A YARN INTO A PNEUMATIC YARN TEXTURING MEANS

[75] Inventors: Bernard Biot, Craponne; Charles Blanc, Couzon-au-Mont-D'Or, both of France

[73] Assignee: Rhone-Poulenc-Textile, Paris, France

[21] Appl. No.: 812,680

[22] Filed: Jul. 5, 1977

Related U.S. Application Data

[63] Continuation of Ser. No. 692,766, Jun. 4, 1976, abandoned.

[30] Foreign Application Priority Data

Jun. 6, 1975 [FR] France ..... 75 17993
Jun. 6, 1975 [FR] France ..... 75 17994

[51] Int. Cl.[3] ..... D02G 1/12; D02G 1/16
[52] U.S. Cl. ..... 28/255; 28/272
[58] Field of Search ..... 28/272, 255; 226/7, 226/97

[56] References Cited

U.S. PATENT DOCUMENTS

| | | | |
|---|---|---|---|
| 2,675,908 | 4/1954 | Griset, Jr. | 226/7 |
| 3,175,290 | 3/1965 | Bunting, Jr. et al. | 226/97 X |
| 3,424,359 | 1/1969 | Houle et al. | 226/97 |
| 3,452,910 | 7/1969 | Richter | 226/97 X |
| 3,570,339 | 3/1971 | Vandersip | 226/97 X |
| 3,837,052 | 9/1974 | Martin et al. | 28/272 |
| 3,970,231 | 7/1976 | Sturtz et al. | 226/97 X |

FOREIGN PATENT DOCUMENTS

| | | | |
|---|---|---|---|
| 526813 | 6/1956 | Canada | 28/272 |
| 1474625 | 2/1967 | France . | |
| 490942 | 7/1970 | Switzerland . | |
| 717193 | 10/1954 | United Kingdom | 28/272 |

*Primary Examiner*—Robert Mackey
*Attorney, Agent, or Firm*—Sherman & Shalloway

[57] ABSTRACT

A method for introducing yarn into a pneumatic yarn texturizing means, in which the yarn is positioned across the inlet orifice of the texturizing means, a stream of fluid is forced against the yarn to introduce it into the orifice in the form of a loop and a yarn cutting device, located downstream of the orifice in the direction of movement of the yarn, is actuated, its operation being synchronized with that of the fluid stream.

7 Claims, 8 Drawing Figures

METHOD FOR INTRODUCING A YARN INTO A PNEUMATIC YARN TEXTURING MEANS

This is a continuation of application Ser. No. 692,766, filed June 4, 1976, now abandoned.

The present invention relates to a method and a device for introducing at least one yarn into pneumatic yarn texturizing means.

It is known that in using means of texturizing a yarn, one of the more difficult operations is that which consists of passing the said yarn into the device used when starting up. As a general rule, old-fashioned means are available for this purpose, consisting of a metal wire heddle-hook which is introduced through the outlet end of the device and passed through the latter in order to hook onto the yarn at the end intended for its feed. These means are not only old-fashioned but also, if texturizing is carried out in line with the manufacture of the yarn and at a high speed, generally cause the wastage of a not insignificant amount of material; furthermore, above a certain speed, of the order of 2,000 meters per minute, starting-up by means of a heddle-hook becomes impossible.

Means of automatically introducing a yarn into a suction device are known. Thus according to U.S. Pat. No. 3,564,958, a yarn traveling along a defined path is introduced automatically, not into a means of texturizing, but into a waste suction nozzle located near the yarn. A movable injector, having a mechanical and pneumatic action, combined with a yarn-cutting device, is employed. The injector first of all mechanically pushes the yarn in the direction of the suction nozzle so as to start a loop and then, after the yarn has been cut, a fluid under pressure emitted by the injector propels the yarn into the suction nozzle.

However, means of automatic introduction of a yarn into a pneumatic texturizing device are not known.

According to the present invention we provide a method of introducing at least one yarn into pneumatic yarn texturizing means, said method comprising leading the yarn from a yarn feed means, positioning the yarn across the inlet orifice of the yarn texturizing means and at right angles to the axis of the latter, cutting the yarn downstream from the orifice, relative to the direction of travel of the yarn, forming a loop in the yarn solely under the influence of a pressurized fluid stream synchronized with the yarn-cutting device, and propelling the loop by means of the fluid stream into the inlet orifice of the texturizing means and thereafter drawing the yarn into the texturizing means.

The present invention also relates to a device for introducing at least one yarn into pneumatic yarn texturizing means, said device comprising:

(a) an orifice for introducing yarn into the texturizing means;
(b) means for positioning the yarn across the orifice;
(c) a fluid nozzle positioned to direct fluid into said orifice;
(d) means for supplying fluid under high pressure to said fluid nozzle;
(e) yarn cutting means located downstream from the orifice, relative to the direction of travel of the yarn; and
(f) means for synchronizing the functioning of the fluid supply means and of the yarn-cutting device, the device being so adapted to draw aside after the introduction of the yarn and allow the texturizing to take place under the usual conditions.

By "fluid" there is to be understood a gas, a liquid or vapor preferably, water is used.

The fluid acts on the yarn so as to form a loop which is propelled into the feed orifice of the texturizing means; the pressure of the fluid is such that the speed of the fluid is greater than the speed of the yarn.

As the means of cutting, the device used comprises a blade and a counter-blade, located in a plane which is at right angles, or substantially at right angles, to the path of the yarn, one of these elements being fixed while the other is connected to the movable core of an electromagnet and is returned to its rest position by a spring. Devices of this type are described, for example, in Swiss Pat. No. 490,942 and French Pat. No. 1,474,625. Preferably, a shear cutting device is used which comprises a cutting blade located in a plane substantially at right angles to the direction of travel of the yarn positioned by said positioning means, a long-stroke electromagnet, a core of said electromagnet connected to the cutting blade, a return coil spring acting on said core, a counter-blade being located opposite said cutting blade, an opening in said counter-blade through which the yarn held by said positioning means passes, and a leaf spring contacting the cutting blade to press it against the counter-blade during cutting, whereby the cutting blade travels parallel to the counter-blade.

The device also comprises means for positioning the yarn, for example, a groove machined in the assembly, or grooved rollers, so as to guide the yarn in front of the inlet orifice of the texturizing means.

The yarn can be started either from a stopped position or at high speed, the yarn generally being drawn in by a known means downstream from the inlet orifice of the texturizing means. The drawing in process can be accomplished by using the texturizing fluid to suck the end of the yarn into the texturing means.

In order that the present invention will be better understood, the following description is given, merely by way of a non-limiting example, reference being made to the accompanying drawings, in which.

Figure 1:
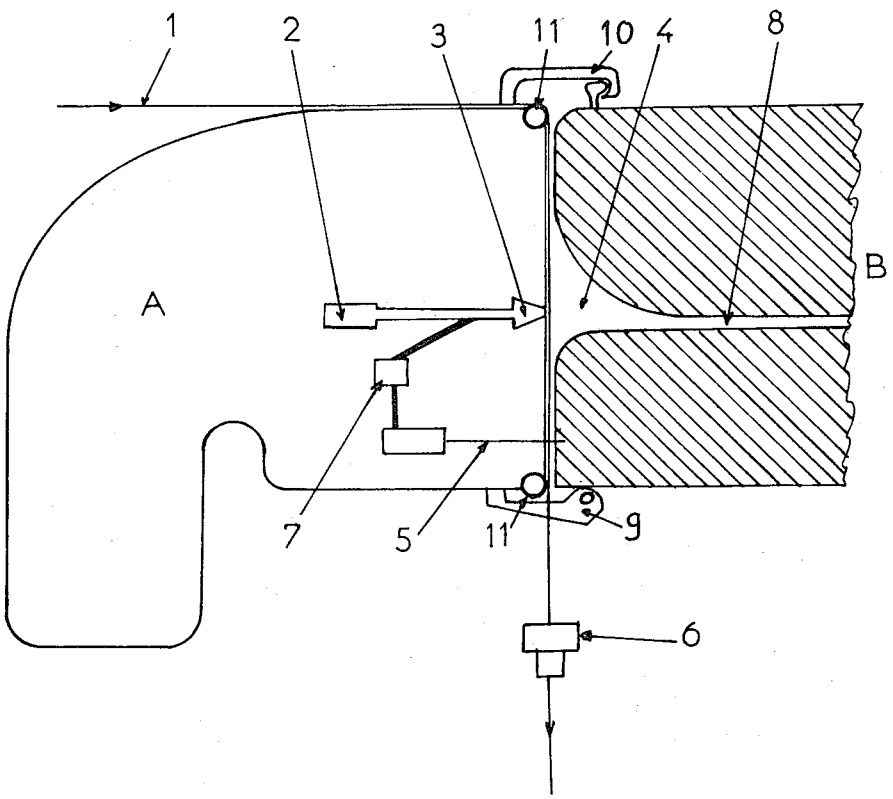
FIG. 1 is a schematic side elevation, in section, through one embodiment of device according to the invention, in position in front of a pneumatic yarn texturizing means.

In FIG. 1 there is illustrated the device A for introducing the yarn, in the starting position in front of a pneumatic yarn texturizing means B. FIG. 1 shows a yarn 1, a fluid supply means 2 for feeding a fluid under high pressure and an injection nozzle 3 situated opposite the orifice 4 for introducing the yarn into the yarn texturizing means B, a yarn-cutting device 5, a take-up nozzle 6 and the means 7 of synchronizing the operation of the fluid supply means and of the yarn-cutting device 5.

Figure 4:
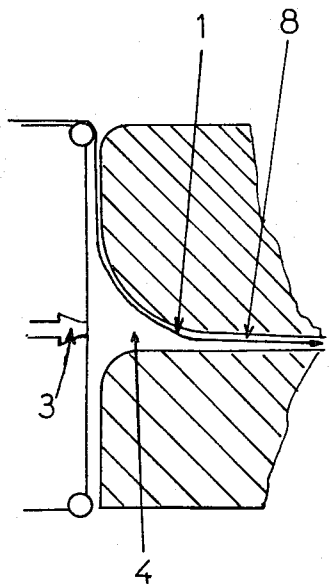
FIGS. 2 to 4 are scrap sections which represent the different stages of introducing the cut yarn into the texturizing means.
Figure 3:
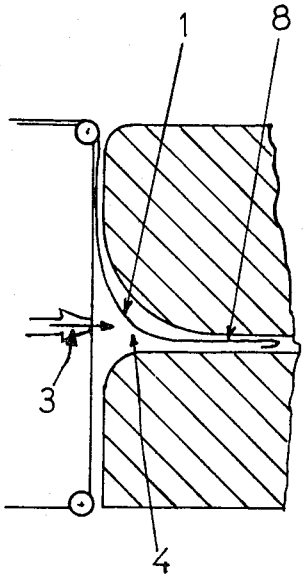
Figure 2:
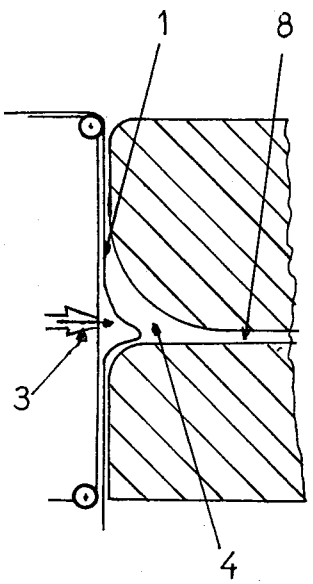

When it is desired to introduce the yarn into the texturizing means B, the yarn 1, coming from a supply which is not shown, is positioned on the starting assembly A by grooved rollers 11 in front of the orifices 3 and 4 and is drawn through by the take-up nozzle 6. The cutting of the yarn by means of the device 5, the deflection of the yarn and its propulsion into the orifice 4 and the channel 8, by emitting the jet of fluid under pressure, the jet issuing from the injection head 3 (FIGS. 2 and 3) are brought about simultaneously by the synchronization means 7, the yarn thereafter being drawn, as it leaves the channel 8, into the texturizing means by the texturizing fluid (FIG. 4). After introducing the yarn, the device A is disengaged from in front of texturizing means B and the texturizing operation takes place in the usual manner. In general, the orifice 4 is a profiled slot in the form of a flat funnel so as to facilitate the formation and passage of the loop, as indicated in FIG. 3; its width is constant and of a size preferably slightly greater than the diameter of the yarn. As indicated in FIG. 1, the upper and lower profiles of the orifice have a radius of curvature, the radius of curvature of the upper profile generally being larger so as to avoid, as far as possible, friction of the loop against the walls of the slot and thus assist its introduction into the orifice 4 and the channel 8.

The means of feeding the said fluid under high pressure are preferably a source under pressure which is external to the device; the application of pressure can also be effected on the device by a known means (such as a pump or pressure accumulator).

The injection head 3 generally consists of a blow-tube of round or rectangular cross-section. The jet is triggered by any known means, such as a quick-action valve. The means of synchronization 7 ensure that the cutting and the jet take place simultaneously.

Figure 5:
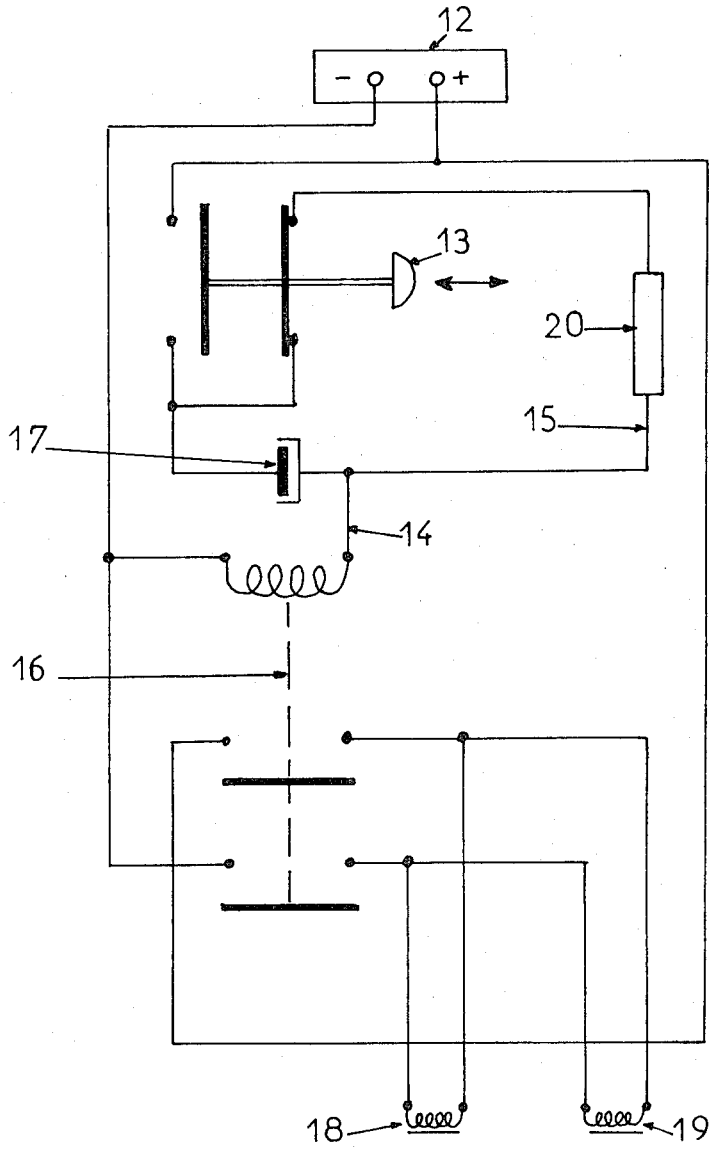
FIG. 5 is a circuit diagram showing the electrical control circuit for triggering the jet of fluid onto the yarn, triggering the yarn-cutting device, and synchronizing these operations.

An example of the operation of the means of synchronization is shown in FIG. 5, in which can be seen:

a source 12 of direct or rectified current of 24 V/10 A, a two-way pushbutton 13 shown in the "rest" position so that the control circuit is open and the discharge circuit is closed, a control circuit 14, a discharge circuit 15, and an electromagnetic relay 16 which is normally open.

In operation, on pressing the button 13, the discharge circuit 15 is opened and the control circuit 14 is closed, which results in the closing of the electromagnetic relay 16 for a time t which is a function of the value of the capacitance 17, and hence causes the application of a potential, for this same time t, to the solenoid valve 18 which controls the injection of fluid and the electromagnet 19 which controls the yarn-cutting device.

As a result, the time for which the relay is closed is independent of the time for which the button 13 is pressed. On releasing the button 13 control circuit 14 opens and the discharge circuit 15 closes, which allows the capacitance 17 to discharge into the resistance 20.

In general, the jet of fluid does not act along the axis of the orifice for the introduction of the yarn; preferably it acts along an axis which is parallel to the axis of the channel 8 and is located upstream from the latter, as shown in FIG. 1; it issues through an orifice which can be of round or rectangular cross-section, preferably the latter, the width of the jet being preferably less than the width of the orifice for the introduction of the yarn, so as to maintain the cohesion of the jet for as long as possible.

The cut is effected by means of a blade and counter-blade device at right angles, or substantially at right angles, to the path of the yarn, one of these two elements being fixed and the other connected to the movable core of an electromagnet which is returned to its rest position by a spring. Preferably, a device of this type, in which the yarn passes through a recess in the fixed counter-blade, is used; during cutting, the blade shifts parallel to the counter-blade and is kept pressed against the latter by a leaf spring.

Figure 6:
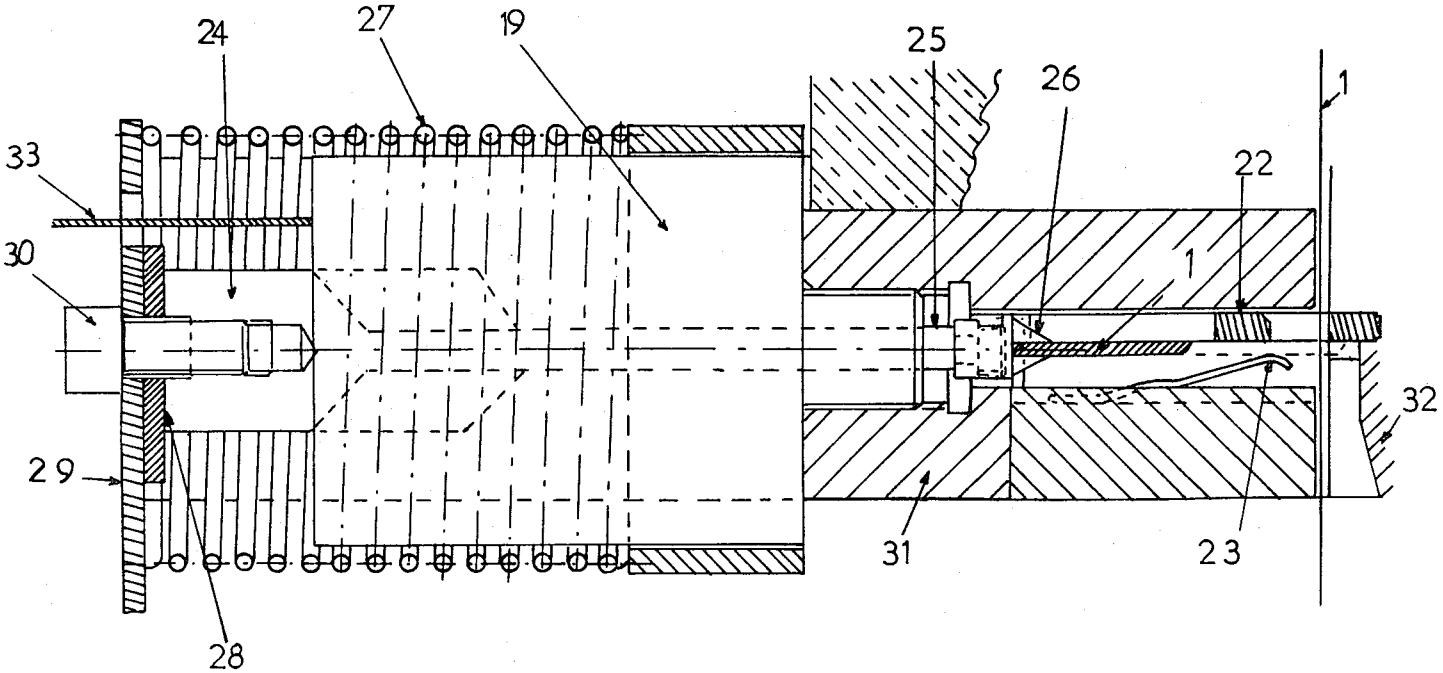
FIG. 6 is a cross-section through the yarn-cutting means of the device of FIG. 1.

An embodiment is shown in FIG. 6. It comprises a cutting blade 21, a counter-blade 22, a leaf spring 23, an electromagnet 19, a movable core 24 of the electromagnet 19 connected to a rod 25, means 26 for joining the cutting blade 21 to the rod 25, a coil spring 27 surrounding the electromagnet 19, a rubber disc 28, a washer 29 and the screw 30, the framework 31 for holding the electromagnet/cutting blade assembly, a framework 32 for holding the counter-blade 22, and a source 33 of electricity for the electromagnet.

Figure 7:
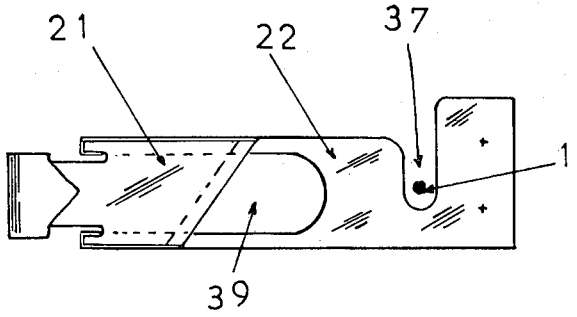
FIG. 7 is an underneath plane of the cutting blade/-counter-blade assembly.

FIG. 7 shows an underneath plan of the assembly of the cutting blade 21 and the counter-blade 22, the cutting blade 21 being in the rear position relative to the counter-blade 22 and the yarn 1 which passes through a recess 37 machined in the counter-blade 22.

Figure 8:
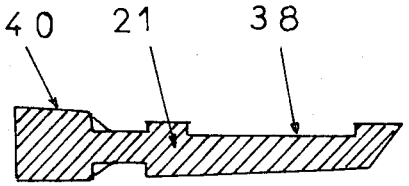
FIG. 8 is a side view of the cutting blade.

As seen in FIG. 8, the cutting blade 21 has a recess 38 on its face opposite the counter-blade 22. This permits friction, during the forward and return movement, of the cutting part of the blade 21 against the counter blade 22—beyond the travel of the blade 21 over the space 39 of the counter-blade 22, and allowing for the presence of the heel 40 of the blade—thus resulting in shelf-sharpening of the blade 21. This is an advantage of the cutting device which is capable of cutting a yarn, subjected to high speeds of the order of 2,000 to 3,000 m/minute or more, in a very short time, less than a thousandth of a second.

In operation, current is supplied at 33 to the electromagnet 19 for a predetermined time t, which produces the thrust of the core 24 and of the rod 25 which carries forward the spring 27 and the rubber disc 28 as well as the cutting blade 21 under the counter-blade 22, and results in a positive action of the blade against the lower face of the counter-blade, with the blade, by virtue of its profile, pushing the yarn into the base of the recess of the counter-blade, and cutting it at the same time. The return of the blade to its first position is brought about by the combined action of the spring 27, which expands, and of the rubber disc 28 which, as in the cutting phase, acts as a shock absorber.

The starting device can be mounted independently or non-independently of the texturizing device. For example, if the starting device is mounted on the texturizing device, it can be mounted to pivot about an axis 9 and be secured by a holding device 10.

For better positioning of the starting device in front of the texturizing device, a centering member may be provided. Preferably, the distances between the upper grooved roller and the orifice for the introduction of the yarn, and between the said orifice and the yarn-cutting device should be reduced to a minimum. The yarn can be positioned on the starting device whether the latter is in the open or closed position in front of the texturizing device; in general, the yarn is brought into place by a yarn suction nozzle.

The pneumatic texturizing devices which can be coupled to the starting device of the present application are, for example, those described in French Pat. Nos. 1,289,491, 2,052,161 and 2,110,561. The yarn introduced may be a continuous yarn of artificial or synthetic material.

Of course, the starting device which forms the subject of the present application can be used for the introduction of yarn into devices other than the pneumatic or non-pneumatic texturizing means of the present application.

The examples which follow illustrate the present application without limiting it.

EXAMPLE 1

A device which forms the subject of the present invention, in which the means of guiding the yarn consist of grooved rollers, is coupled to the texturizing means described in French Pat. No. 2,052,161; the fluid means of starting the yarn are water kept under a pressure of 30 bars and acting on the yarn as it leaves through the orifice of a rectangular blow-tube of cross-sectional size $0.25 \times 1.2$ mm; the amount of water acting on the yarn being 3 $cm^3$.

A yarn of gauge 2,300 dtex/136 strands, of polyhexamethylene-adipamide, is introduced into the texturizing means, by the process described above, at a speed of 2,400 meters/minute, into the channel 8, the end of which is of round cross-section of diameter 1.8 mm, the feed pressure of the texturizing fluid (steam) being 12 bars. To introduce the yarn into the texturizing means, the cutting device is actuated, which then severs the yarn, the cutting time which elapses between cutting the first of the 136 strands and the last of the 136 strands is 0.2 millisecond.

EXAMPLE 2

A polyhexamethylene-adipamide yarn of gauge 1,750 dtex/102 strands is introduced at a speed of 3,000 meters/minute, by means of the starting device of the present application, and in accordance with the process described above, into the texturizing device described in French Pat. No. 2,052,161, the loop being formed, after cutting the yarn, under the action of a jet of water which strikes the yarn under a pressure of 40 bars, the jet issuing from an orifice of a rectangular blow-tube of cross-sectional size $0.25 \times 1$ mm; the amount of water acting on the yarn is 3 $cm^3$; the loop is then drawn into the texturizing means at the outlet of the channel 8 by steam fed in at a pressure of 12 bars.

We claim:

1. A method of introducing at least one yarn into an inlet orifice of a pneumatic yarn texturizing means, said method comprising the steps of:

leading the yarn at a high speed from yarn feed means along a path across the inlet orifice of the yarn texturizing means wherein said path is at right angles to the axis of the orifice;

cutting the yarn downstream of the orifice to form a free end for introduction into the texturizing means;

impinging a highly pressurized stream of fluid on the yarn, the stream of fluid substantially perpendicular to the yarn, while cutting the yarn to propel a portion of the yarn occurring upstream of the free end thereof into the orifice solely under the influence of said pressurized stream;

forming a loop of yarn solely under the influence of said pressurized stream;

propelling the loop of yarn into the orifice of the texturizing means solely under the influence of said pressurized stream with the free end trailing; and thereafter drawing the yarn into the texturizing means for processing.

2. A method according to claim 1, wherein the stream of fluid is a stream of water.

3. The method of claim 1, wherein the stream of fluid is impinged on the yarn at a point upstream from and generally parallel to the axis of the inlet orifice.

4. The method of claim 1, wherein the stream of pressurized fluid is directed horizontally and the yarn path across the inlet orifice is vertical.

5. The method of claim 1 wherein the stream of fluid is moved from juxtaposition with the orifice after the yarn is introduced through the orifice and into the texturizing device so as to allow texturizing to take place under usual conditions.

6. A method according to claim 1, wherein the high speed is greater than 2,000 meters/minute.

7. The method of claim 6, wherein the highly pressurized stream of fluid is applied with a pressure in the range of 30–40 bars.

* * * * *